US008099992B2

(12) United States Patent
Rouweler et al.

(10) Patent No.: US 8,099,992 B2
(45) Date of Patent: Jan. 24, 2012

(54) AUTOMATIC SAFETY CLICK

(75) Inventors: Franciscus Wilhelmus Rouweler, Arnhem (NL); Gerrit Bruggink, Hengelo (NL)

(73) Assignee: WILA B.V., DB Lochem (NL)

( * ) Notice: Subject to any disclaimer, the term of this patent is extended or adjusted under 35 U.S.C. 154(b) by 1212 days.

(21) Appl. No.: 11/807,761

(22) Filed: May 30, 2007

(65) Prior Publication Data

US 2008/0040864 A1 Feb. 21, 2008

(30) Foreign Application Priority Data

Jun. 1, 2006 (EP) ..... 06011423

(51) Int. Cl.
*B21D 37/04* (2006.01)

(52) U.S. Cl. ..... 72/481.2; 72/481.1; 72/482.91; 72/389.3; 72/462

(58) Field of Classification Search ..... 72/389.3, 72/389.4, 389.6, 462, 481.1, 481.2, 481.3, 72/481.6, 481.9, 482.2, 482.3, 482.6, 482.91
See application file for complete search history.

(56) References Cited

U.S. PATENT DOCUMENTS

| | | | | |
|---|---|---|---|---|
| 1,425,727 | A | 5/1922 | Wallstrom | |
| 1,708,854 | A | 4/1929 | Stahlhut | |
| 2,468,055 | A | 4/1949 | Gibler | |
| 2,570,726 | A | 10/1951 | Smith | |
| 2,812,080 | A | 11/1957 | Campos | |
| 4,355,940 | A | 10/1982 | Derickson | |
| 5,009,098 | A | 4/1991 | van Merksteijn | |
| 5,022,256 | A | 6/1991 | van der Meulen | |
| 5,082,415 | A | 1/1992 | Hayashi | |
| 5,103,665 | A | 4/1992 | van Merksteijn | |
| 5,245,854 | A * | 9/1993 | Bruggink et al. | 72/462 |
| 5,908,374 | A | 6/1999 | Kato | |
| 6,003,360 | A * | 12/1999 | Runk et al. | 72/482.2 |
| 6,264,417 | B1 | 7/2001 | Salsburg | |
| 6,267,116 | B1 | 7/2001 | McMichael | |
| 6,327,884 | B1 | 12/2001 | Wills | |
| 6,467,327 | B1 | 10/2002 | Runk et al. | |
| 6,516,649 | B1 | 2/2003 | Mika et al. | |
| 6,557,390 | B2 | 5/2003 | Runk et al. | |
| 6,564,611 | B2 * | 5/2003 | Harrington et al. | 72/481.2 |
| 6,575,169 | B2 | 6/2003 | McMichael | |
| 6,581,606 | B2 | 6/2003 | Kutzko et al. | |
| 6,581,607 | B2 | 6/2003 | Kutzko et al. | |
| 6,644,090 | B2 * | 11/2003 | Gasparini | 72/482.2 |

(Continued)

FOREIGN PATENT DOCUMENTS

DE 39 33 736 A1 6/1990

(Continued)

OTHER PUBLICATIONS

Wilson Tool, Mar. 2006 Brochure.

*Primary Examiner* — David Jones
(74) *Attorney, Agent, or Firm* — The Webb Law Firm

(57) ABSTRACT

The invention relates to an exchangeable tool for holding in a receiving structure, the tool comprising:

a safety device for preventing the tool from accidentally falling out of the receiving structure, which safety device has a tool releasing position and a tool locking position;

energizable actuating means for actuating the safety device; and energizing means for energizing the actuating means, and to a method for exchanging such tool from a receiving structure.

5 Claims, 7 Drawing Sheets

U.S. PATENT DOCUMENTS

| | | | | |
|---|---|---|---|---|
| 6,732,564 | B2 | 5/2004 | Runk et al. | |
| 6,848,291 | B1 | 2/2005 | Johnson et al. | |
| 6,928,852 | B2 | 8/2005 | Enderink | |
| 6,942,614 | B1 | 9/2005 | Kutzko et al. | |
| 7,004,008 | B2 | 2/2006 | Harrington et al. | |
| 7,021,116 | B2 | 4/2006 | Harrington et al. | |
| 7,308,817 | B2 * | 12/2007 | Shimota et al. | 72/482.1 |
| 7,343,774 | B2 * | 3/2008 | Gascoin et al. | 72/482.2 |
| 7,523,636 | B2 * | 4/2009 | Bessa Pacheco et al. | 72/481.2 |
| 7,632,224 | B2 * | 12/2009 | Rouweler et al. | 72/481.2 |
| 7,634,935 | B2 * | 12/2009 | Mazzocchi | 72/481.1 |
| 7,721,586 | B2 * | 5/2010 | Pabich et al. | 72/481.1 |

FOREIGN PATENT DOCUMENTS

| | | | |
|---|---|---|---|
| DE | 43 21 314 | A1 | 1/1995 |
| DE | 20 2005 010693 | U1 | 9/2005 |
| EP | 0 494 714 | A1 | 7/1992 |
| EP | 0 974 422 | A1 | 1/2000 |
| EP | 1 698 408 | A | 9/2006 |
| JP | 06 115891 | A | 4/1994 |
| NL | 9100034 | | 8/1992 |
| NL | 1014147 | | 9/2001 |
| WO | WO 2004/024361 | A | 3/2004 |

* cited by examiner

AUTOMATIC SAFETY CLICK

The invention relates to an exchangeable tool for holding in a receiving structure, the tool comprising:

a safety device for preventing the tool from accidentally falling out of the receiving structure, which safety device has a tool releasing position and a tool locking position.

Such a device is for example known from the European patent No. 0 494 714. According to this publication a tool is arranged with a safety member, which protrudes out of the surface of the tool and engages in a cavity of the receiving structure. When the clamping force of the receiving structure is removed, the safety member prevents the tool from falling out. Only after operating a push button the safety member is retracted and the tool can be taken out of the receiving structure, substantially perpendicular to the length of the receiving structure. The claims recite an actuating member, which can be embodied as a push button. The actuating member can however not convert energy into a movement to retract the safety device.

When automating the exchange of tools, a manipulator is used to take the tools out of the receiving structure and to arrange tools in said receiving structure. With the tools according to the prior art having a safety device, this safety device has to be operated in order to be able to remove the tools from the receiving structure, substantially perpendicular to the length of the receiving structure. Accordingly the manipulator has to be equipped with a gripper, which not only grips and holds the tool, but also operates the safety device.

Several grippers are already known, which mechanically operate the safety device in the same manner as a human operator would do. The disadvantage of such grippers is the low flexibility in handling different types of tools. Such grippers are only able to operate tools in which the push button is arranged at a known position. For example a small tool has only one push button, while a large and long tool generally has at least two push buttons. Such known grippers are only able to operate one of the two types of tools. In order to be able to exchange both types of tools, the robot has to change the gripper to be able to exchange the other tool.

It is now an object of the invention to provide for an exchangeable tool, which allows for a better flexibility and enable an automatic exchanging system to exchange different types of tools with just one gripper.

This object of the invention is achieved by an exchangeable tool, which is characterized by actuating means for actuating the safety device; and energizing means for energizing the actuating means. By arranging the actuating means in the exchangeable tool, the gripper of the manipulator no longer needs to have a specific device to actuate for example the push button of a tool. These actuating means are energized by the energizing means, such that the energy is converted to a movement urging the safety device from the tool releasing position towards the tool locking position or from the tool releasing position to the tool locking position to lock the tool in the receiving structure.

In a preferred embodiment of the tool according to the invention the actuating means comprise an electric motor for driving the safety device from the tool locking position to the tool releasing position in order to remove the tool from the receiving structure or from the tool releasing position to the tool locking position to lock the tool in the receiving structure. With such an embodiment the energizing means supply an electric current to the electric motor. This electric current is easily provided for by for example the gripper of the manipulator or through the receiving structure.

Preferably the actuating means comprise a screw spindle, driven by the electric motor, which screw spindle is connected to the safety device. This screw spindle enables to convert the rotation of the electric motor into a linear movement, which is advantageous for example in a tool using a push button.

In another embodiment of the tool according to the invention the actuating means comprise an electromagnet for driving the safety device from the tool locking position to the tool releasing position in order to remove the tool from the receiving structure or from the tool releasing position to the tool locking position to lock the tool in the receiving structure.

In yet another embodiment of the invention the actuating means comprise a transmission to redirect the driving force of the actuating means under an angle, e.g. perpendicular. Due to the shape of the tool and the receiving structure it is not always possible to arrange the actuating means with their actuating direction in line with the necessary direction of movement of the safety device. By using for example a wedge the direction of the actuating means can be converted to another direction. This enables the actuating means to be arranged at the tool at different locations. Other examples of transmissions are: toothrack-gear transmission, a lever transmission and gear transmission.

Preferably the energizing means comprise a connector connected to the actuating means for receiving energy and transmitting the energy to the actuating means. The energy can be received from for example the gripper of the robot, which provides the energy after it has grabbed the tool, to have the actuating means bring the safety device in the tool releasing position, such that the manipulator can retract the tool from the receiving structure.

In another preferred embodiment of the tool according to the invention, the actuating means comprise a pneumatic or hydraulic cylinder connected to the safety device. Hydraulic or pneumatic pressure is generally available with the receiving structure and can also be used to operate the safety device by the actuating means.

Preferably the energizing means comprise a connector for supplying compressed air or a hydraulic fluid to the cylinder to energize the actuating means. For example the gripper has a pneumatic line, which can be connected to the tool and through which the safety device can be operated. So only after connection of the gripper with the tool the safety device can be operated which increases the safety.

In yet another preferred embodiment of the tool according to the invention, the energizing means and actuating means comprise spring means. Preferably the spring means are tensioned upon insertion of the tool into the receiving structure to store energy and wherein the spring energy is released to actuate the safety device. When inserting the tool into the receiving structure a force is already applied by the manipulator onto the tool. A portion of this force can be stored into spring means as energy and can be used at a later stage to operate the safety device. The releasing of this spring energy can be controlled by control means for example a mechanical action performed by the gripper or by applying a small electric current to a small electric actuator, such as a piezo element.

The invention further relates to a method for exchanging a tool from a receiving structure comprising:

providing an exchangeable tool according to the invention;

grabbing the exchangeable tool;

energizing the energizable actuating means by the energizing means to move the safety device to the tool releasing position;

taking the exchangeable tool from the receiving structure.

The invention also relates to a method for inserting a tool into a receiving structure comprising:

providing an exchangable tool according to the invention;

inserting the tool into the receiving structure substantially perpendicular to the length of the receiving structure;

energizing the energizable actuating means by the energizing means to move the safety device to the tool locking position.

It is further preferred that the energizing means provide an electric current or a pressurized fluid or spring energy to energize the energizable actuating means.

These and other features of the invention will be elucidated with the accompanying drawings.

Figure 1:
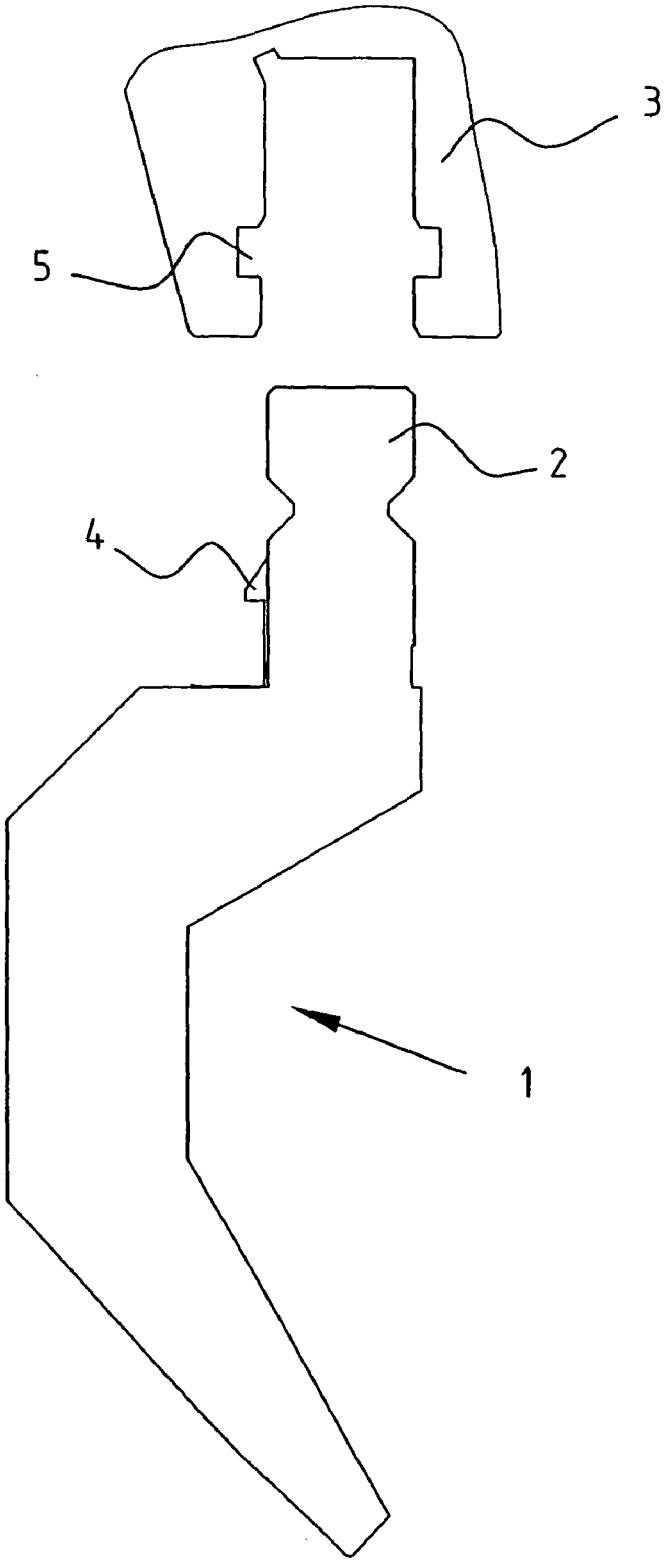
FIG. 1 shows schematically a tool having a safety device and receiving structure.

FIG. 1 shows a tool 1 with a receiving end 2. This receiving end 2 is inserted into a receiving structure 3 which will hold the tool 1. A safety member 4 is provided which protrudes out of the tool 1 and engages with a cavity 5 in the receiving structure 3. This prevents the tool 1 from falling out of the receiving structure 3 when the clamping force is released. Only after actuating the safety member 4 such that it is retracted into the receiving end 2, the tool 1 can be removed from the receiving structure 3.

Figure 2:
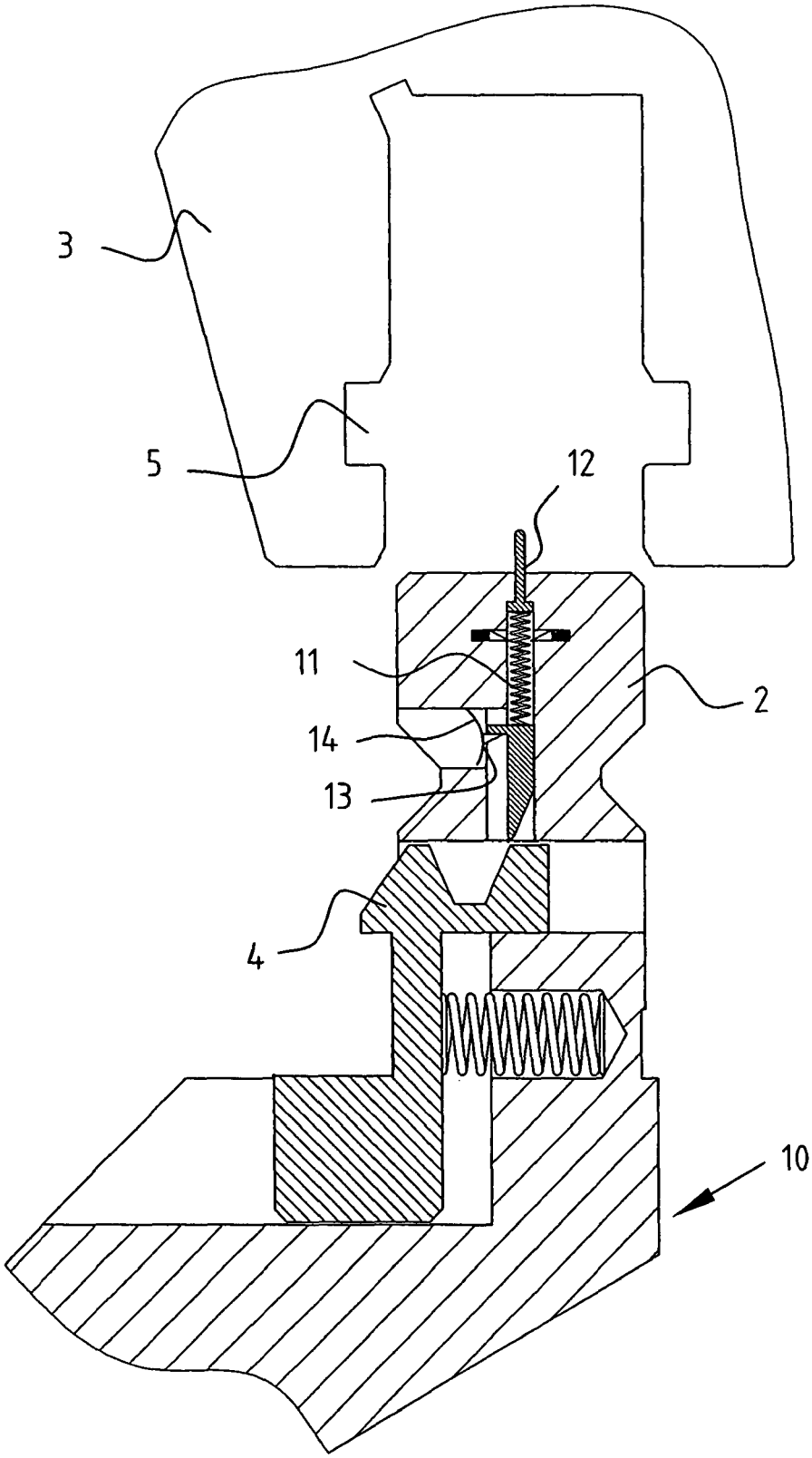
FIG. 2 shows in cross-sectional view a first embodiment of a tool according to the invention in a first position.

FIG. 2 shows in partial cross-sectional view a first embodiment of a tool 10 according to the invention. This tool 10 has also a receiving end 2 and a safety member 4 which can be inserted into the receiving structure 3 and engages with the cavity 5.

The tool 10 is furthermore provided with actuating and energizing means comprising a spring 11, which can be compressed by a pusher 12. The bottom part of the spring 11 is maintained in position by a cam 13, which is connected to a piezo element 14.

Figure 3:
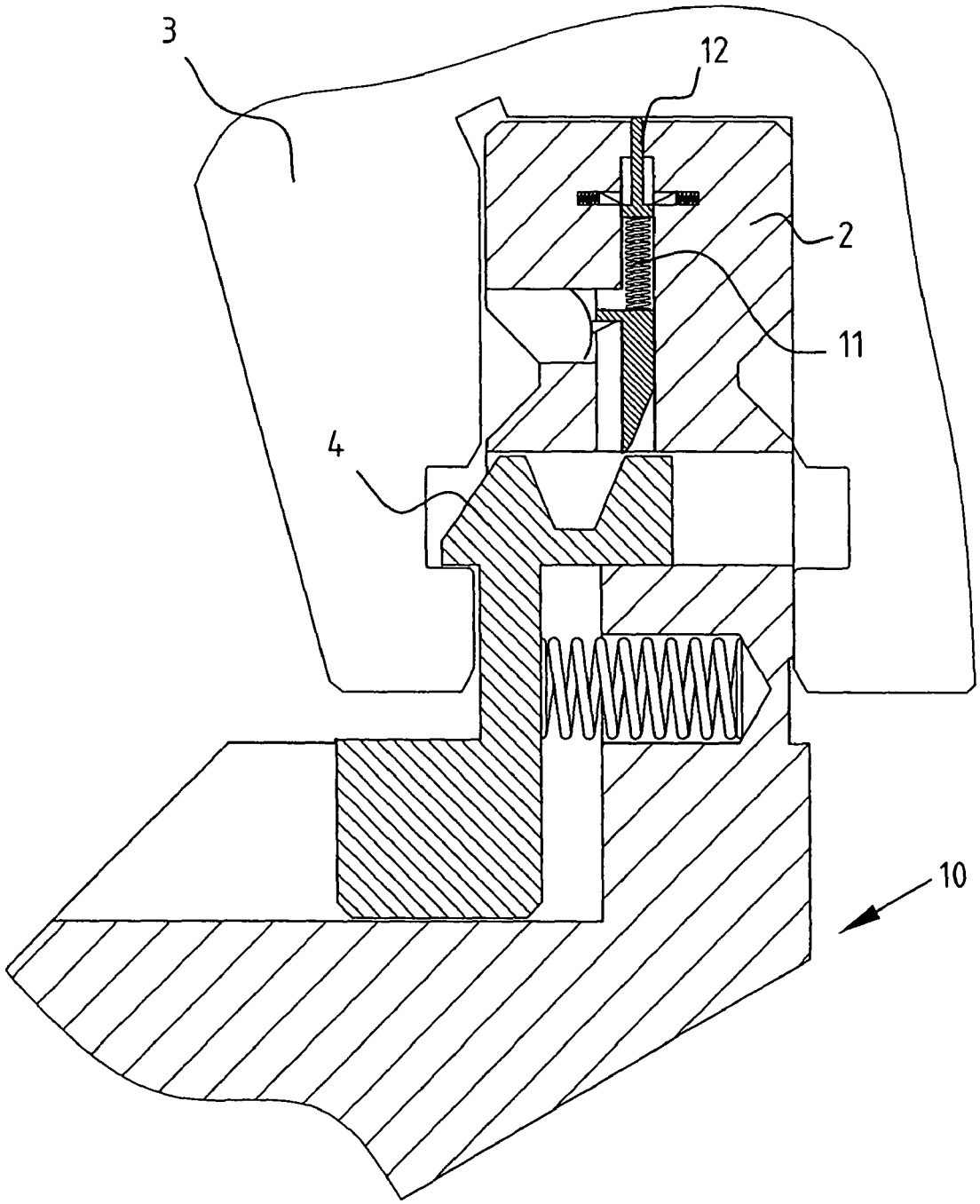
FIGS. 3 and 4 show the device according to FIG. 2 in two different positions.

On insertion of the tool 10 into the receiving structure 3 (see FIG. 3) the pusher 12 is moved into the receiving end 2 of the tool 10, thereby compressing the spring 11 and storing energy. The spring energy of the spring 11 is stored to be used for actuating the safety member 4 at a later stage.

Figure 4:
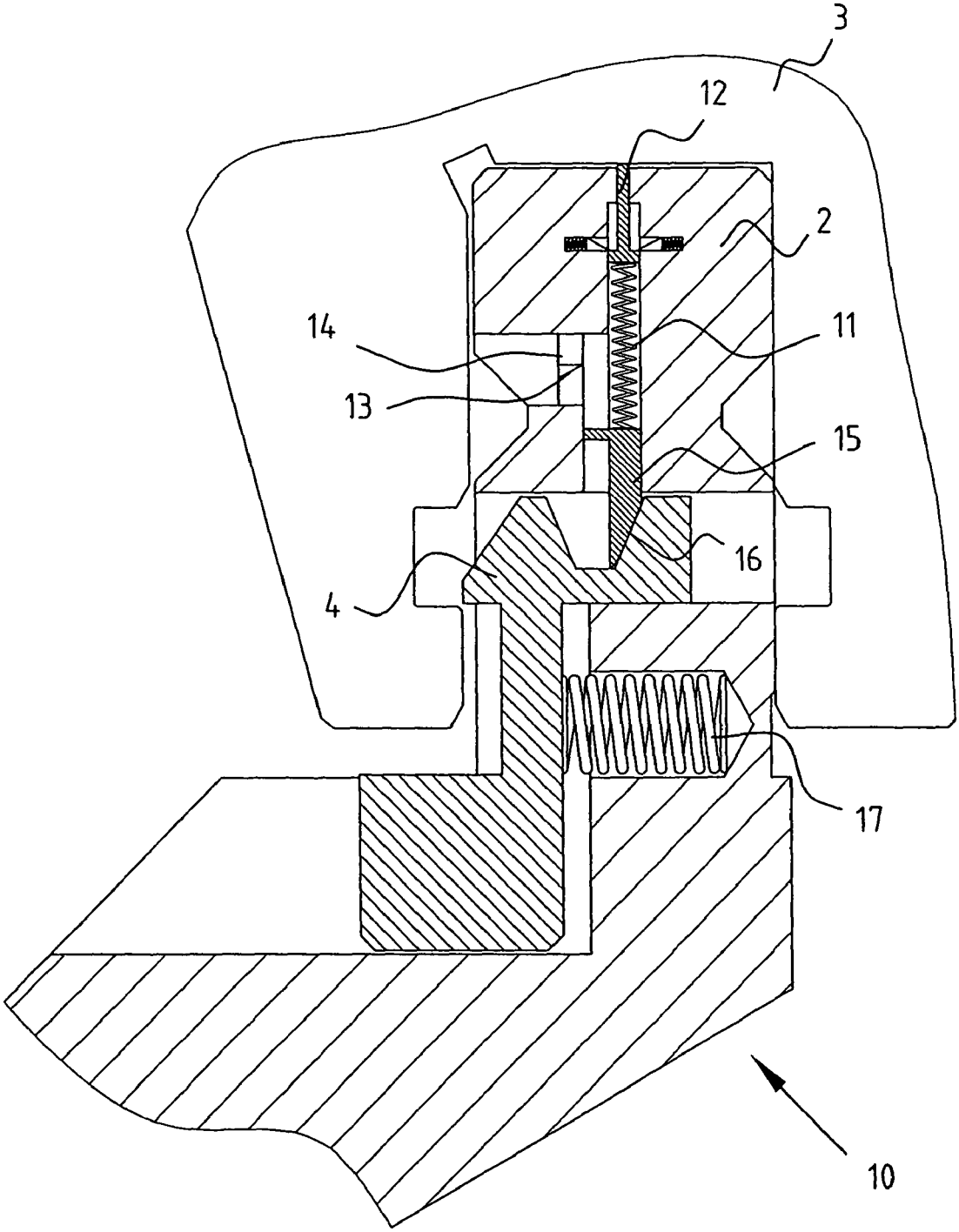

In FIG. 4 the tool 10 is released from the receiving structure 3. First of all the clamping force of the receiving structure 3 is removed and then the piezo element 14 is activated by an electric current, such that the cam 13 is retracted and the spring energy of the spring 11 is released. The spring energy drives a wedge 15 downwards, which coacts with a wedge surface 16 of the safety member 4. The spring 11 now retracts the safety member 4 into the receiving end 2 of the tool 10 enabling removal of the tool 10 from the receiving structure 3. When removing the tool 10 from the receiving structure 3 the pusher 12 will be able to move up making the spring 11 tension free. The spring 17 acting directly on the safety member 4, will after removal of the tool 10 from the receiving structure 3 push the safety member 4 outward again, driving the wedge 15 upward and by deactivating the piezo element 14 the tool 10 is brought into its original state as shown in FIG. 2.

The safety member could also be embodied as a rotatable safety member, which is moved from a tool locking position to a tool releasing position by rotating the safety member, instead of shifting the safety member.

Figure 6:
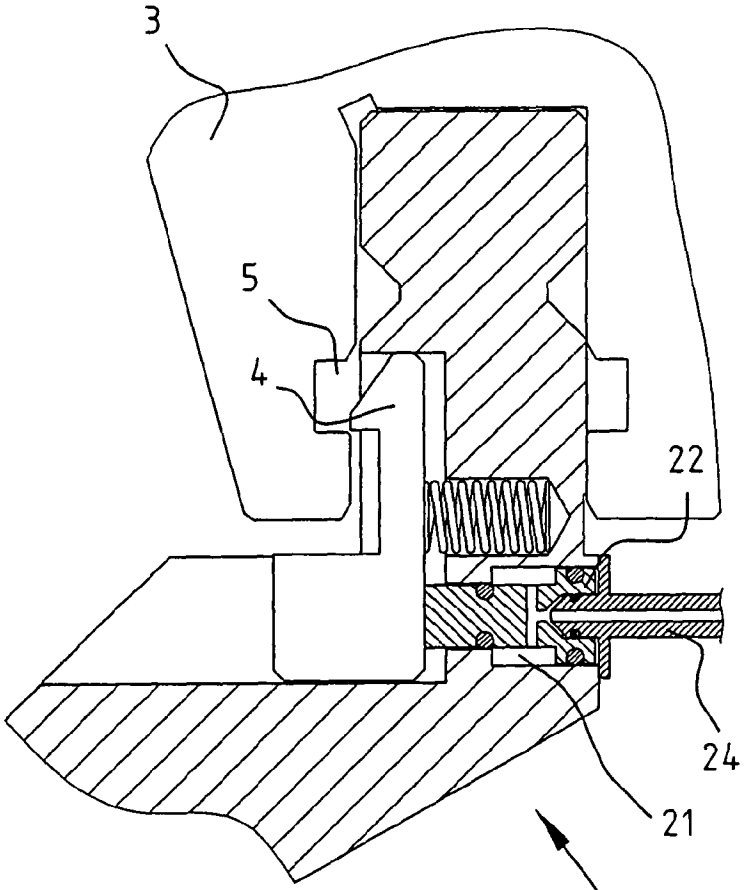
FIGS. 5 and 6 show a second embodiment of a tool according to the invention in two different positions.
Figure 5:
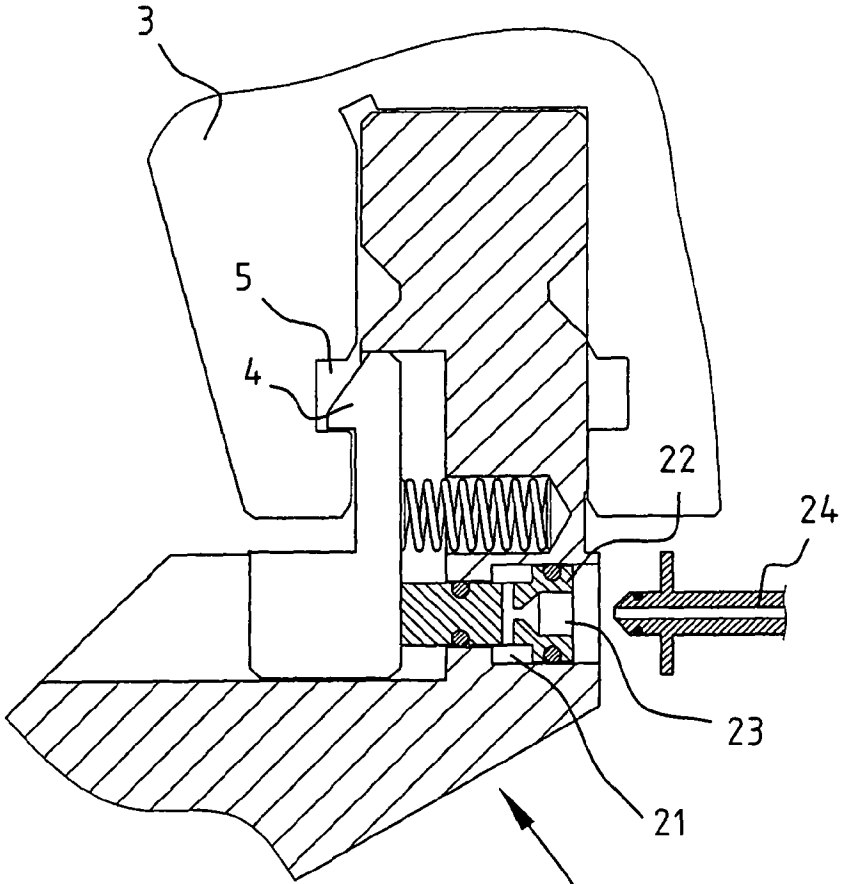

FIGS. 5 and 6 show a second embodiment of a tool 20 according to the invention. FIG. 5 shows the safety member 4 in a tool locking position, while FIG. 6 shows the safety member 4 in a tool releasing position.

The tool 20 is provided with a cylinder 21 in which piston 22 is arranged. This piston 22 is connected to the safety member 4. The piston 22 is provided with an opening 23 connecting to the cylinder 21.

Now when the tool 20 has to be removed from the receiving structure 3 a tube 24 is inserted into the opening 23 (see FIG. 6). After insertion of the tube 24 compressed air is supplied to the cylinder 21 pushing the piston 22 and bringing the safety member 4 from the tool locking position to the tool releasing position.

Figure 7:
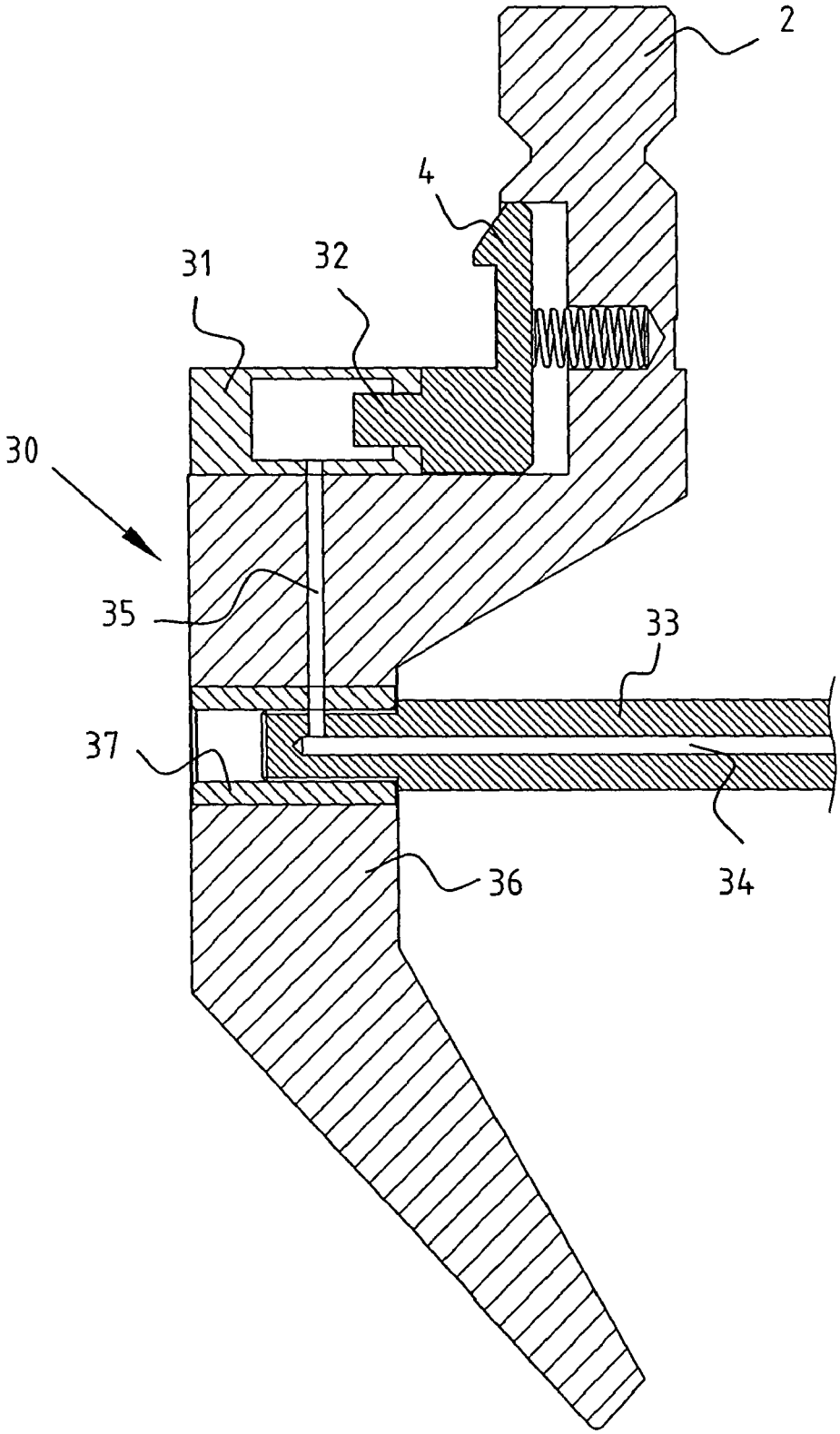
FIG. 7 shows a third embodiment of a tool according to the invention.

FIG. 7 shows a third embodiment of a tool 30 according to the invention. This tool 30 has a cylinder 31 in which part of the safety member 4 acts as a piston 32. The tool 30 has in its body 36 connecting means 37 with which the tool 30 can be grabbed and held. For example a rod 33 can be screwed into this connecting means 37 in order to grab and hold the tool 30. The rod 33 is provided with a channel 34, which connects to a channel 35, which in turn is in connection with the cylinder 31. Again by providing compressed air or a hydraulic fluid the piston 32 is actuated bringing the safety member 4 from a tool locking position to a tool releasing position.

It is also possible to have a heat expandable polymer in the cylinder 31. By expanding the polymer in channel 35 the safety member can be activated. It is possible to expand the polymer using, for instance, heat or an electric current.

Figure 8:
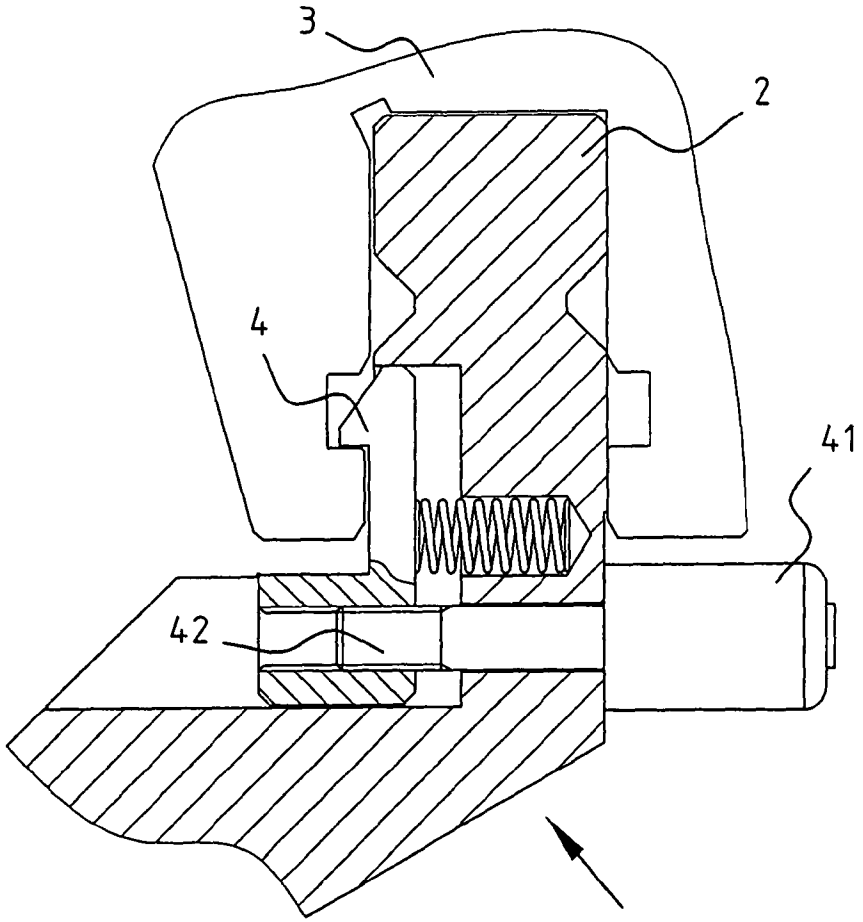
FIG. 8 shows a fourth embodiment in cross-sectional view.

FIG. 8 shows a fourth embodiment of a tool 40 according to the invention. The tool 40 again has a safety member 4. The tool is furthermore provided with an electric motor 41, which drives a screw spindle 42, which screw spindle 42 connects to the safety member 4. By driving the motor 41 the safety member 4 can be moved between the tool locking position and the tool releasing position.

Figure 9:
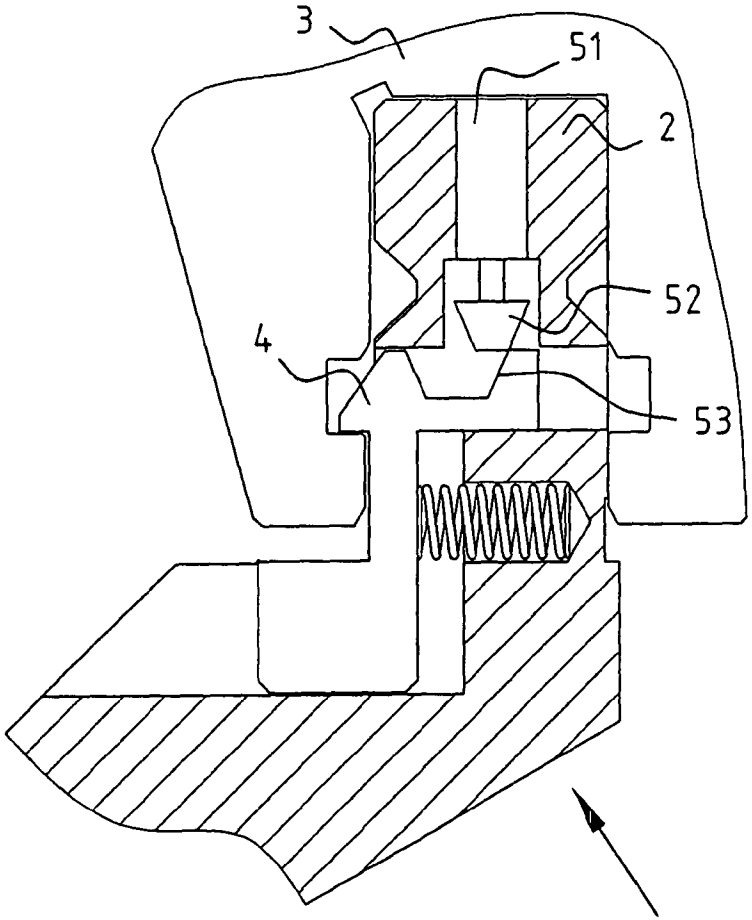
FIG. 9 shows a fifth embodiment of the invention in cross-sectional view.

FIG. 9 shows a fifth embodiment of a tool 50 according to the invention. This tool 50 has in its receiving end 2 an electromagnet 51, which drives a wedge-shaped element 52. This wedge-shaped element engages with an oblique surface 53 present on the safety member 4.

When the electromagnet 51 is actuated the wedge-shaped element is pushed outward and engages the oblique surface 53. This wedge transmission converts the vertical movement of the electromagnet 51 into a horizontal movement bringing the safety member 4 from the tool locking position towards the tool releasing position.

In the embodiments shown, the safety member protrudes from a side surface of the receiving end of the tool. The safety member could also be arranged on top of the tool or any other part of the tool, while being able to be actuated according to the invention.

Furthermore the safety member could also be provided with a push button for manual operation of the safety member in combination with the invention.

The invention claimed is:

1. An exchangeable tool for holding in a receiving structure, the tool comprising:

a safety device for preventing the tool from accidentally falling out of the receiving structure, which safety device has a tool releasing position and a tool locking position;

an energizable actuating means for driving the safety device from the tool locking position to the tool releasing position in order to remove the tool from the receiving structure or from the tool releasing position to the tool locking position to lock the tool in the receiving structure; and an energizing means for energizing the actuating means.

2. The tool according to claim 1, wherein the actuating means comprise a mechanism for driving the safety device from the tool locking position to the tool releasing position in order to remove the tool from the receiving structure, or from the tool releasing position to the tool locking position to lock the tool in the receiving structure.

3. The tool according to claim 1, wherein the energizing means comprise a connector connected to the actuating means for receiving energy and transmitting the energy to the actuating means.

4. The tool according to claim 1, wherein the actuating means comprise a pneumatic or hydraulic cylinder connected to the safety device.

5. The tool according to claim 4, wherein the energizing means comprise a connector for supplying compressed air or a hydraulic fluid to the cylinder to energize the actuating means.

* * * * *